US007494080B2

(12) United States Patent
Knotts

(10) Patent No.: US 7,494,080 B2
(45) Date of Patent: Feb. 24, 2009

(54) HAMMER FOR ROTARY IMPACT CRUSHER

(76) Inventor: Brook H. Knotts, 115 E. 320 North, Salem, UT (US) 84853

( * ) Notice: Subject to any disclaimer, the term of this patent is extended or adjusted under 35 U.S.C. 154(b) by 50 days.

(21) Appl. No.: 11/562,405

(22) Filed: Nov. 21, 2006

(65) Prior Publication Data

US 2007/0114313 A1 May 24, 2007

Related U.S. Application Data

(60) Provisional application No. 60/738,816, filed on Nov. 21, 2005.

(51) Int. Cl.
*B02C 13/28* (2006.01)

(52) U.S. Cl. ..... 241/197; 241/294; 241/300

(58) Field of Classification Search ..... 241/197, 241/300, 195, 294
See application file for complete search history.

(56) References Cited

U.S. PATENT DOCUMENTS 3,866,987 A * 2/1975 Garner ..... 384/95
4,871,119 A * 10/1989 Murata et al. ..... 241/189.1
4,927,305 A * 5/1990 Peterson, Jr. ..... 411/14
5,083,889 A * 1/1992 Steinbock ..... 411/432
6,230,996 B1 * 5/2001 Angers, Jr. ..... 241/27
6,622,951 B1 * 9/2003 Recker et al. ..... 241/195
6,742,735 B2 * 6/2004 Sollami ..... 241/294
7,140,569 B2 * 11/2006 Young ..... 241/195
7,204,442 B2 * 4/2007 Roozeboom et al. ..... 241/191

* cited by examiner

*Primary Examiner*—Mark Rosenbaum
(74) *Attorney, Agent, or Firm*—Angus C. Fox, III

(57) ABSTRACT

An impact hammer mountable to the drum of a rotary crusher employs an attachment bolt having a tapered head which is wedged into a tapered socket in the impact hammer body. A "supernut" is used to secure the bolt to the rotary drum. The supernut is tightened against the rotary shear head until it is snug. Then, threaded locking posts, which pass through the periphery of the supernut, are tightened repeatedly, thereby applying a great deal of tension the bolt shank and effectively stretching it. Any shocks applied to the impact hammer will drive the tapered head of the bolt deeper into the socket of the hammer body block, resulting in the maintenance of a secure hammer-to-drum union. The hammer body also has tungsten carbide chips embedded in a hardfacing material that is applied to the wear surfaces of the hammer.

18 Claims, 5 Drawing Sheets

HAMMER FOR ROTARY IMPACT CRUSHER

This application has a priority date based on the filing of Provisional Patent Application No. 60/738816 on Nov. 21, 2005.

BACKGROUND OF THE INVENTION

1. Field of the Invention

This invention relates to impact hammers for rotary stage loader impact crushers and, more particularly, to impact hammers which are affixed to the rotary head of such a crusher.

2. Description of the Prior Art

The longwall method of underground coal mining, which was implemented during the latter half of the twentieth century, is generally considered to represent the most revolutionary advance in coal mining technology in history. Longwall mining now accounts for about 31% of underground coal production. There are about 100 longwall operations in the United States, with most of them being in Appalachia. In longwall mining, a cutting head moves back and forth across a vertical face at one end of a seam of coal being mined. The vertical face, or "wall", typically has a width within a range of about 250 to 400 meters, and a height within a range of 1 to 2 meters. The seam of coal may be several kilometers in length. The cut coal falls onto a flexible conveyor for removal. Longwall mining is done under hydraulic roof supports (shields) that are advanced as the seam is progressively cut away. The roof in the mined out areas falls as the shields advance. About ninety percent of the coal within a seam is recoverable using the method. Stage loader crushers, which are generally of the rotary impact type, are used as part of the longwall mining system to crush lump coal and oversize rock for easier conveying and to prevent jamming of the conveyer system. Such crushers are manufactured by companies such as Joy Mining Machinery, Inc. And McLanahan Corporation. The crushers typically utilize a rotary drum onto which impact hammers having tungsten carbide inserts are affixed. Hammers produced by original equipment manufactures (OEMs) are often affixed to a rotary drum with a roll pin inserted through a mounting post. However, because the roll pin represents a common failure point, bolting of the hammer to the drum has become increasingly common. The hammer generally has a hollow mounting post so that a bolt can be inserted through the hollow post and then secured with a nut to an anchor on the rotary drum. Although the bolted design constitutes a significant improvement over the roll-pin secured hammer, the bolt is still prone to failure.

Another problem with OEM hammers is that the steel hammer blank, to which tungsten carbide inserts are welded, is subject to rapid wear.

SUMMARY OF THE INVENTION

The present invention provides an impact hammer mountable to a rotary crusher head having tungsten carbide chips embedded in a hardfacing material that is applied to the wear surfaces of the hammer. In addition, the impact hammer has a hollow mounting post that enables the hammer to be bolted to the rotary shear head. The aperture through the mounting post joins and is coaxial with a tapered bolt head socket, or recess. The mounting bolt is unique in that the head is tapered, so that the more the bolt head in pulled into the socket, the tighter the fit between the head and the bolt head socket. A special "supernut" is used to secure the bolt to the rotary shear head. The supernut is tightened against the rotary shear head until it is snug. Then, threaded locking posts (there are eight of them), which pass through the periphery of the supernut, are tightened repeatedly, thereby applying a great deal of tension the bolt shank. The bolt may be stretched far more using a supernut than by simply tightening a conventional nut, as the threads of a conventional nut and those on the bolt would strip if the application of the same amount of tension were attempted. This is because the threaded locking posts have about double the surface area compared to threads of a conventional nut. Because of the extreme tension results in a significant stretching of the tapered head bolt, any shocks applied to the impact hammer will drive the tapered head of the bolt deeper into the socket of the hammer body block, resulting in an increasingly secure hammer-to-head union.

DETAILED DESCRIPTION OF THE INVENTION

The invention will now be described with reference to the attached drawing FIGS. 1 through 15. It should be understood that although the drawings are intended to be merely illustrative, a reasonable attempt has been made to provide drawings which are close to scale.

Figure 1:
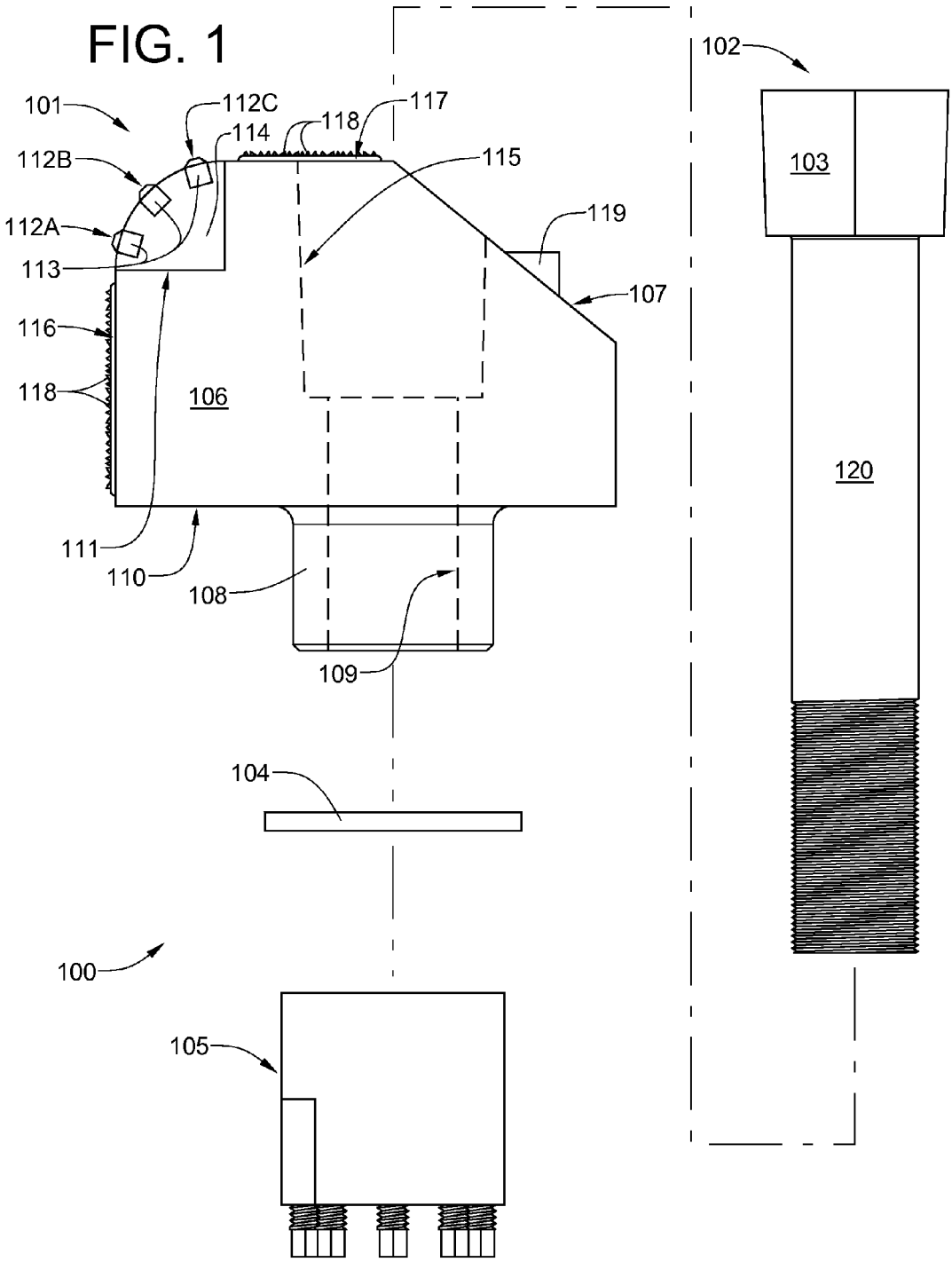
FIG. 1 is an exploded view of the hammer assembly, including a completed hammer (shown in a left side elevational view), the tapered-head attachment bolt, flat washer and supernut.

Referring now to FIG. 1, a hammer assembly 100 includes the hammer 101, an attachment bolt 102 having a tapered hexagonal head 103, a flat washer 104 and a "supernut" 105. It should be understood that the supernut 105 is a commercially available prior art device, and that the inventor makes no claim to that device alone. The hammer 101 includes a body block 106 having a chamfered upper rear face 107, a mounting post 108 which has a concentric aperture 109 that has been precision drilled or cut therethrough, and a lower mounting surface 110. The hammer body block 106 has a generally right-angled cutout 111 into which three rows 112A, 112B and 112C of tungsten carbide inserts 113 will be installed using a hard-facing weldment 114 of chrome, molybdenum, nickel and base steel. The hammer body block 106 is preferably cast from high-strength steel, and then subjected to machining and/or milling operations for cleanup of the casting and for precision formation of the cutout 111 and precision formation of certain other features. For example, the mounting post 108, itself, and lower mounting surface 110 are precision machined and/or milled to ensure that the diameter and length of the mounting post 108 are in compliance with stated specifications, and that the lower mounting surface 110 is planar. It will be noted that the concentric aperture 109 is continuous with a tapered hexagonal bolt head socket 115 that becomes smaller as it approaches the concentric aperture 109. The tapered hexagonal head 103 is sized so that it fits into the tapered bolt head socket 115, but does not seat on the ledge formed at the intersection of the socket 115 and the concentric aperture 109. It should be understood that machining of both the tapered hexagonal head 103 and the bolt head socket 115 are precision machines to tight tolerances. It will be noted that the front face 116 and upper face 117 of the hammer body block 106 are covered with a protective coating of tungsten carbide chips 118, which are attached by hard-facing material to those faces. A pool of molten hard-facing material is created on the face and the tungsten carbide chips 118 are poured into the molten pool. These protective coatings reduce the rate of wear to those faces, which are subjected to abrasion during crushing operations. The protrusion 119 on the chamfered rear face 107 provides a face for an identification number, which is cast thereon. It will be noted that the attachment bolt 102 has a cylindrical shank 120 that is threaded at the lower end thereof.

Figure 2:
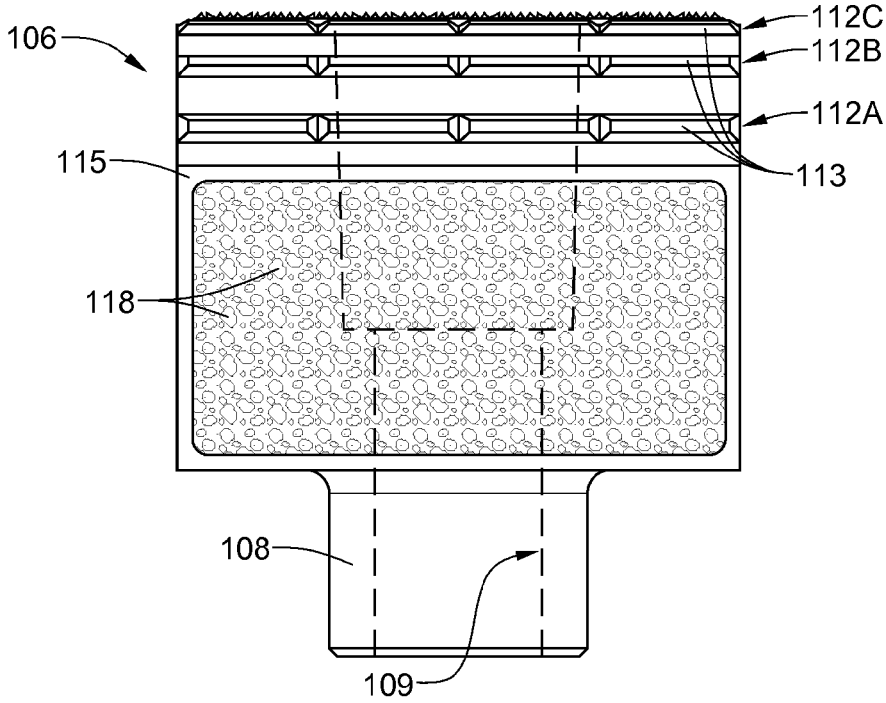
FIG. 2 is a front elevational view the completed hammer.

Referring now to FIG. 2, in this front view of the hammer body block 106, it can be seen how the tungsten carbide chips 118 protect the front face 115. The three rows 112A, 112B and 112C of tungsten carbide inserts 113 are also visible in this view, as is the layer of tungsten carbide chips 118 on the upper face 117, which are seen in profile. The mounting post 108 is also visible in this view.

Figure 3:
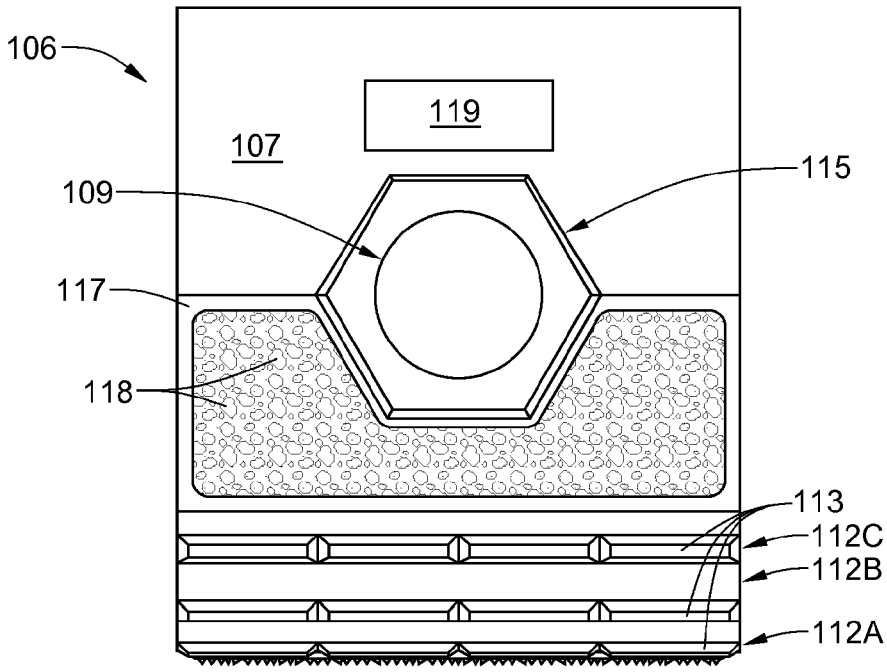
FIG. 3 is a top plan view of the completed hammer.

Referring now to FIG. 3, this top view of the hammer body block 106 clearly shows the tapered nature of the bolt head socket 115. Also visible are the three rows 112A, 112B and 112C of tungsten carbide inserts 113 and the tungsten carbide chips 118 which are embedded in hard-facing material on the upper face 117. The chamfered rear face 107 and the protrusion 119 thereon are also clearly visible in this view.

Figure 4:
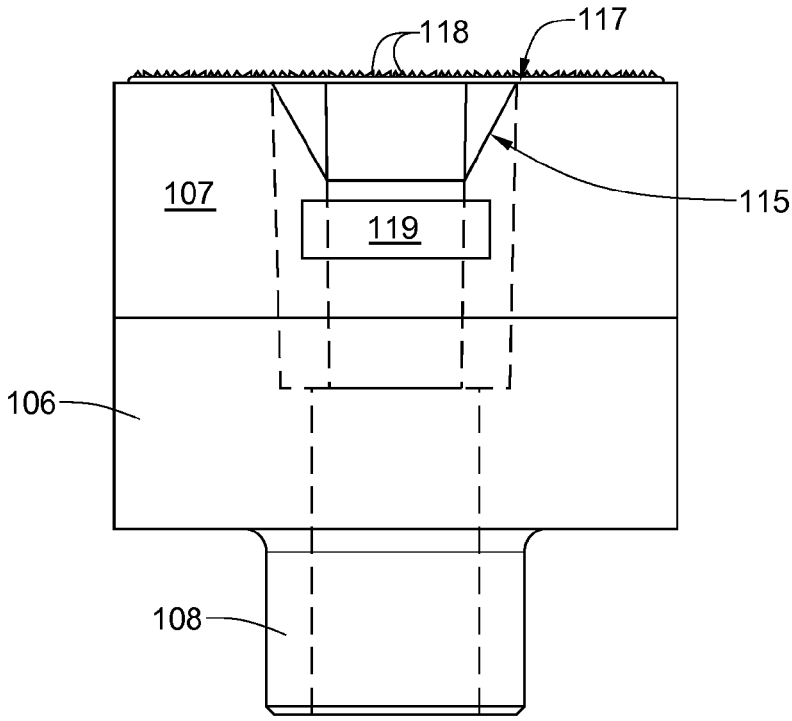
FIG. 4 is a rear elevational view of the completed hammer.

Referring now to FIG. 4, this rear view of the hammer body block 106 shows the tungsten carbide chips 118 on the upper face 117 in profile, the bolt head socket 115, the chamfered rear face 107, the identification protrusion 119 thereon, and the mounting post 108.

Figure 5:
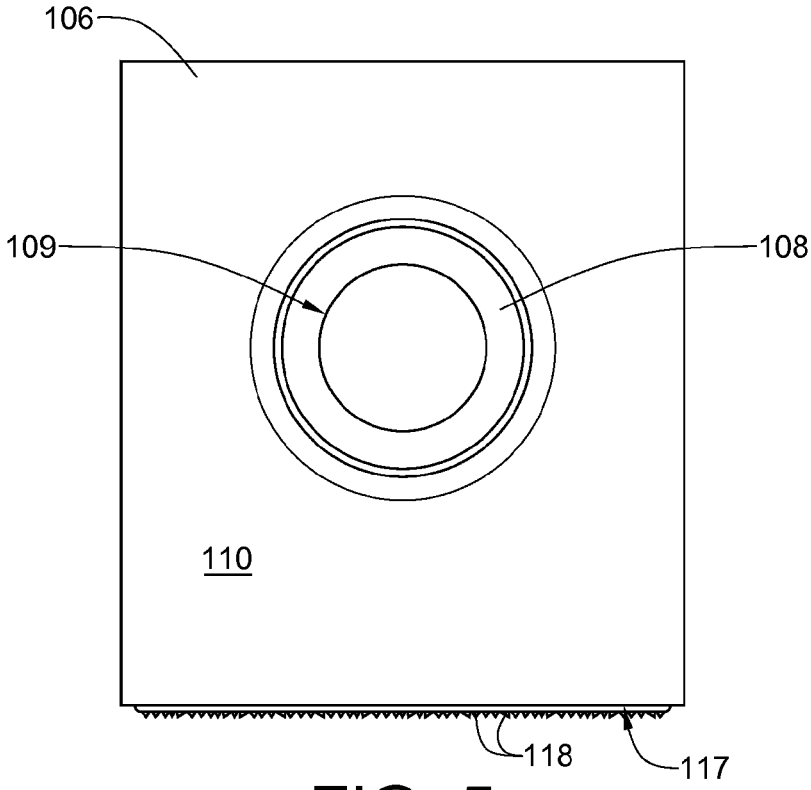
FIG. 5 is a bottom plan view of the completed hammer.

Referring now to FIG. 5, this bottom view of the hammer body block 106 shows the planar lower mounting surface 110, the mounting post 108, the concentric aperture 109, and the tungsten carbide chips 118 which are embedded in hard-facing material on the front face 116.

Figure 6:
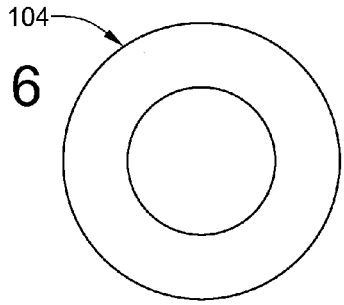
FIG. 6 is a top plan view of the flat washer.

Referring now to FIG. 6, the flat washer 104 is seen in a top view. The washer is preferably made of high strength steel and will not measurably deform under the expected loads.

Figure 7:
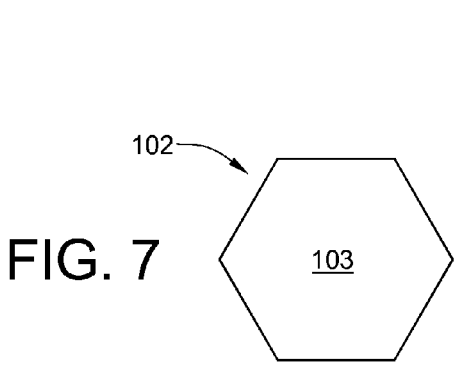
FIG. 7 is a top plan view of the tapered-head attachment bolt.
Figure 8:
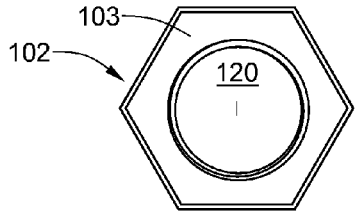
FIG. 8 is a bottom plan view of the tapered-head attachment bolt.

Referring now to FIGS. 7 and 8, the attachment bolt 102 is seen in both top and bottom views. The bottom view of FIG. 8 clearly shows that the hexagonal head 103 is, indeed, tapered.

Figure 9:
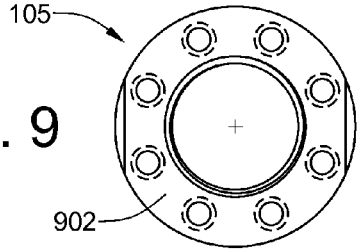
FIG. 9 is a top plan view of the supernut with the threaded locking posts removed.

Referring now to FIG. 9, the supernut 105 is shown with the threaded locking posts removed to show the eight threaded apertures 901, which extend through the periphery 902 of the supernut 105. It will be noted that the supernut 105 has a pair of opposed and parallel flats 903A and 903B, which enable the supernut 105 to be initially tightened with a wrench during the installation of the hammer assembly 100 on a crusher drum.

Figure 10:
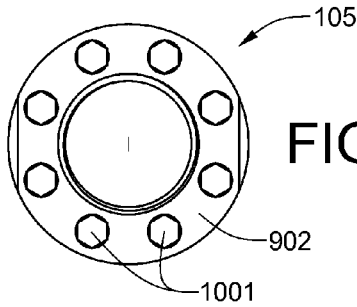
FIG. 10 is a top plan view of the supernut with the threaded locking posts threadably installed therein.

Referring now to FIG. 10, the supernut 105 is shown with the threaded locking posts 1001 installed therein.

Figure 11:
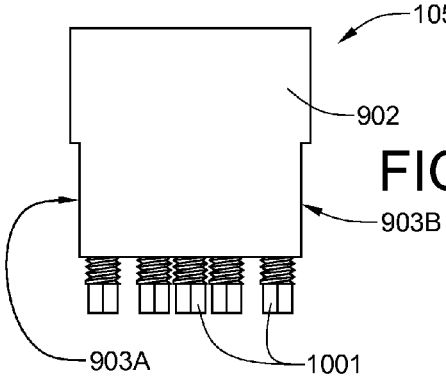
FIG. 11 is a side elevational view of the supernut and installed locking posts taken at an angle parallel to the flats.
Figure 12:
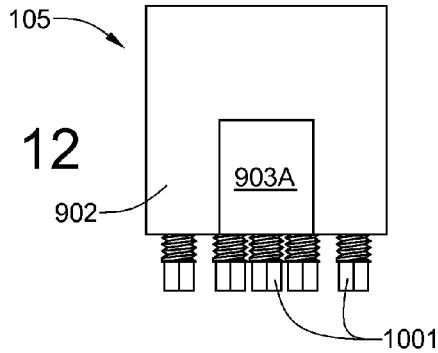
FIG. 12 is a side elevational view of the suppernut and installed locking posts taken at an angle perpendicular to the flats.

Referring now to FIGS. 11 and 12, the suppernut and installed locking posts 1001 are shown in FIG. 11 as a view taken at an angle parallel to the flats 903A and 903B and then, in FIG. 12, as a view taken at an angle perpendicular to the flats 903A and 903B. Once the supernut 105 is snugged using a wrench which engages the flats 903A and 903B, much greater tightening forces can be applied by tightening the individual locking posts 1001 in a presecribed pattern, which may be circular or a rotating X pattern.

Figure 13:
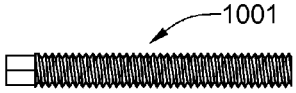
FIG. 13 is a side elevational view of a locking post.

Referring now to FIG. 13, a single threaded locking post 1001 is shown. Each locking post 1001 extends through one of eight threaded apertures 901.

Figure 14:
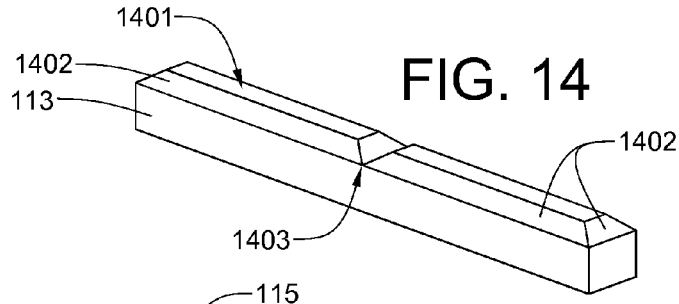
FIG. 14 is an isometric view of one of the six tungsten carbide inserts installed in the completed hammer.

Referring now to FIG. 14, a single tungsten carbide insert 113 is shown. It will be noted that the crushing face 1401 has chamfered edges 1402 and a central notch 1403. Each row 112A, 112B and 112C employs two linearly-arranged tungsten carbide inserts 113.

Figure 15:
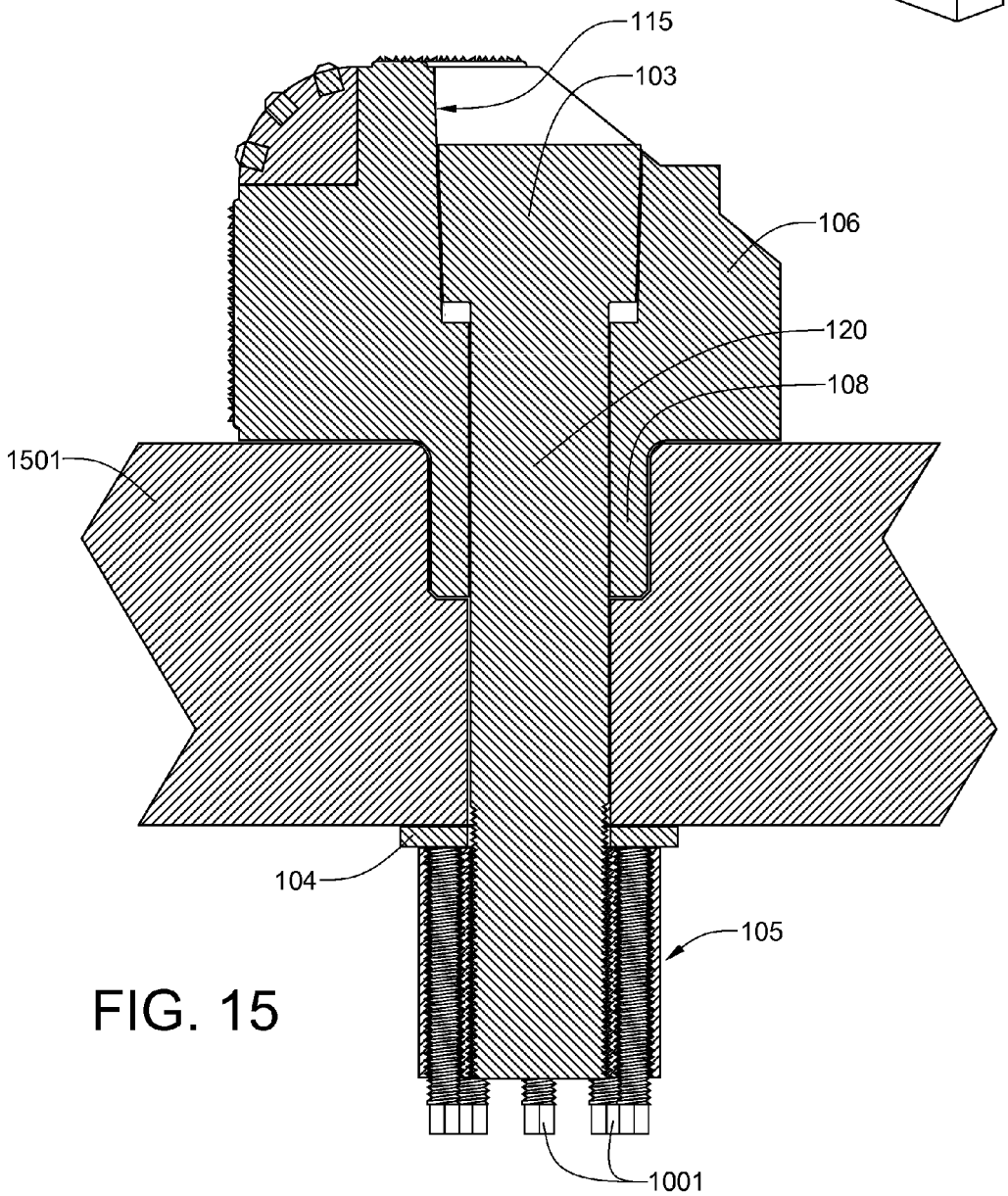
FIG. 15 is a cross-sectional view of the hammer assembly installed on the drum of a stage loader rotary impact crusher.

Referring now to FIG. 15, the hammer assembly 100 is shown installed on the drum 1501 of a stage loader rotary impact crusher. It will be noted that the tapered bolt head 103 is wedged within the the bolt head socket 115 in the hammer body block 106. The supernut 105 has been threadably installed on the bolt shank 120 and snugged against the flat washer 104. Then, the threaded locking posts 1001 are repeatedly tightened in a presecribed sequence, thereby applying a great deal of tension to the cylindrical bolt shank 120 and effectively causing it to stretch. The shank 120 can be stretched far more using a supernut 105 than by simply tightening a conventional nut, as the threads of a conventional nut and those on the mounting bolt would strip if the application of the same amount of tension on the bolt shank 120 were attempted. This is because the eight threaded locking posts 1001 have about double the surface area (taken together as a group) compared to threads of a conventional nut. Because of the extreme tension results in a significant stretching of the attachment bolt 102, any shocks applied to the impact hammer will drive the tapered head 103 deeper into the bolt head socket 115 of the hammer body block 106, thereby resulting in the maintenance of a secure hammer-to-drum union.

Although only a single embodiment of the invention has been shown and described, it will be obvious to those having ordinary skill in the art that changes and modifications may be made thereto without departing from the scope and the spirit of the invention.

What is claimed is:

1. An impact hammer assembly mountable on the drum of a rotary crusher, said impact hammer comprising:

a body block having at least one tungsten carbide crusher insert welded thereto, said body block also having a generally cylindrical mounting post, said mounting post having a cylindrical aperture and a tapered socket which are adjoining and axially aligned;

a drum attachment bolt having a shank insertable through the cylindrical aperture and a tapered head which is wedged into the tapered socket with an interference fit, said shank passing through a portion of the drum; and a supernut having an annular component threadably securable to a lower portion of said shank, said annular component having a plurality of threaded apertures, each of which has an axis which is parallel to a major central axis of the supernut, said supernut also having a plurality of threaded locking posts, each of which threadably engages a threaded aperture, said plurality of threaded locking posts being individually tightenable to tension and stretch the shank of said bolt.

2. The impact hammer assembly of claim 1, which further comprises a layer of tungsten carbide particles embedded in a hard-facing weldment layer applied to wear surfaces on said body block.

3. The impact hammer assembly of claim 2, wherein said hard-facing weldment layer comprises chromium, molybdenum, nickel and steel.

4. The impact hammer assembly of claim 2, wherein said mounting post extends from a planar mounting surface.

5. The impact hammer assembly of claim 2, which further comprises a flat washer sized to slide over said shank and positionable between said supernut and said body block.

6. The impact hammer assembly of claim 5, wherein said supernut has eight threaded locking posts, all of which are individually tightenable against said washer using a specified tightening sequence.

7. The impact hammer assembly of claim 1, wherein said shank is sufficiently stretched so that said tapered head will continue to work its way into the tapered socket during the expected life of the hammer.

8. An impact hammer assembly mountable on the drum of a rotary crusher, said impact hammer comprising:

a body block having at least one tungsten carbide crusher insert welded thereto, said body block also having a generally cylindrical mounting post, said mounting post having a cylindrical aperture and a tapered socket which are adjoining and axially aligned;

a drum attachment bolt having a shank insertable through the cylindrical aperture and a tapered head which is wedged into the tapered socket with an interference fit, said shank passing through a portion of the drum; and a supernut having an annular component threadably securable to a lower portion of said shank, said annular component incorporating a plurality of threaded apertures, each threaded aperture having an axis which is parallel to a major central axis of the supernut, said supernut also having a plurality of threaded locking posts, each of said locking posts threadably engaging a threaded aperture, said plurality of threaded locking posts being individually tightenable to tension and stretch the shank of said drum attachment bolt.

9. The impact hammer assembly of claim 8, which further comprises a layer of tungsten carbide particles embedded in a hard-facing weldment layer applied to wear surfaces on said body block.

10. The impact hammer assembly of claim 9, wherein said hard-facing weldment layer comprises metals selected from the group consisting of chromium, molybdenum, nickel and steel.

11. The impact hammer assembly of claim 9, wherein said mounting post extends from a planar mounting surface.

12. The impact hammer assembly of claim 8, which further comprises a flat washer sized to slide over said shank and positionable between said supernut and said body block.

13. The impact hammer assembly of claim 12, wherein said supernut has eight threaded locking posts, all of which are individually tightenable against said washer using a specified tightening sequence.

14. The impact hammer assembly of claim 8, wherein said shank is sufficiently stretched so that said tapered head will continue to work its way into the tapered socket during the expected life of the hammer.

15. An impact hammer assembly mountable on the drum of a rotary crusher, said impact hammer comprising:

a body block having at least one tungsten carbide crusher insert welded thereto;

a layer of tungsten carbide particles embedded in a hard-facing weldment layer applied to wear surfaces on said body block; and a generally cylindrical mounting post, said mounting post extending from a planar mounting surface, and having both a cylindrical aperture and a tapered socket which are adjoining and axially aligned;

a drum attachment bolt having a shank insertable through the cylindrical aperture and a tapered head which is wedged into the tapered socket with an interference fit, said shank passing through a portion of the drum; and a supernut having an annular component threadably securable to a lower portion of said shank, said annular component incorporating a plurality of threaded apertures, each threaded aperture having an axis which is parallel to a major central axis of the supernut, said supernut also having a plurality of threaded locking posts, each of said locking posts threadably engaging a threaded aperture, said plurality of threaded locking posts being individually tightenable to tension and stretch the shank of said drum attachment bolt, so that said tapered head will continue to work its way into the tapered socket during the expected life of the hammer.

16. The impact hammer assembly of claim 15, wherein said hard-facing weldment layer comprises metals selected from the group consisting of chromium, molybdenum, nickel and steel.

17. The impact hammer assembly of claim 15, which further comprises a flat washer sized to slide over said shank and positionable between said supernut and said body block.

18. The impact hammer assembly of claim 17, wherein said supernut has eight threaded locking posts, all of which are individually tightenable against said washer using a specified tightening sequence.

* * * * *